US006766589B1

(12) United States Patent
Bory et al.

(10) Patent No.: US 6,766,589 B1
(45) Date of Patent: Jul. 27, 2004

(54) PORTABLE HAND DRYER

(76) Inventors: Maria Regina Bory, 320 Elderberry, La Verne, CA (US) 91750; Christopher Gregory Bory, 320 Elderberry, La Verne, CA (US) 91750

( * ) Notice: Subject to any disclaimer, the term of this patent is extended or adjusted under 35 U.S.C. 154(b) by 0 days.

(21) Appl. No.: 10/670,688

(22) Filed: Sep. 25, 2003

(51) Int. Cl.[7] ..... F26B 19/00

(52) U.S. Cl. ..... 34/90; 34/239; 392/380; 392/381

(58) Field of Search ..... 34/90, 96, 97, 34/218, 239; 392/380, 381, 382, 383

(56) References Cited

U.S. PATENT DOCUMENTS

| | | | | |
|---|---|---|---|---|
| 1,494,883 | A | | 5/1924 | Bassette et al. |
| 1,750,094 | A | | 3/1930 | Emmrich |
| 1,765,915 | A | | 6/1930 | Haase |
| 2,184,858 | A | | 12/1939 | Goodman |
| 2,490,019 | A | | 12/1949 | Elliot |
| 2,504,740 | A | | 4/1950 | Siegel |
| 2,646,629 | A | | 7/1953 | Clemens |
| 2,761,222 | A | | 9/1956 | Bennett |
| 3,305,938 | A | | 2/1967 | Goldstein |
| 3,667,134 | A | | 6/1972 | Rockson |
| 3,766,397 | A | | 10/1973 | Rockson |
| 4,087,925 | A | | 5/1978 | Bienek |
| 4,336,619 | A | | 6/1982 | Hinkel et al. |
| 4,594,797 | A | | 6/1986 | Houck, Jr. |
| 4,785,162 | A | | 11/1988 | Kuo |
| 4,802,287 | A | | 2/1989 | Chen |
| 4,811,159 | A | * | 3/1989 | Foster, Jr. ..... 361/231 |
| 4,924,604 | A | * | 5/1990 | Colodner et al. ..... 34/619 |
| 4,999,929 | A | * | 3/1991 | Dutton ..... 34/90 |
| 5,111,594 | A | | 5/1992 | Allen |
| RE34,018 | E | | 8/1992 | Petersen et al. |
| 5,146,695 | A | | 9/1992 | Yang |
| 5,163,234 | A | | 11/1992 | Tsukamoto et al. |
| 5,186,360 | A | | 2/1993 | Mease et al. |
| 5,442,867 | A | * | 8/1995 | Robinson ..... 34/90 |
| 5,459,944 | A | | 10/1995 | Tatsutani et al. |
| 5,535,089 | A | * | 7/1996 | Ford et al. ..... 361/231 |
| 5,873,178 | A | | 2/1999 | Johnson |
| 6,185,838 | B1 | * | 2/2001 | Moore ..... 34/202 |
| 6,189,230 | B1 | | 2/2001 | Huen |
| 6,216,363 | B1 | * | 4/2001 | Swansen et al. ..... 34/415 |
| 6,364,165 | B2 | * | 4/2002 | Sampson et al. ..... 222/102 |

* cited by examiner

*Primary Examiner*—Ira S. Lazarus
*Assistant Examiner*—Kathryn S. O'Malley
(74) *Attorney, Agent, or Firm*—Denton L. Anderson; Sheldon & Mak

(57) ABSTRACT

A portable hand dryer has an air blower and, optionally, an air heater. The hand dryer includes a laterally protruding male electrical plug having at least two prongs which provides electricity to the blower and which allows the hand dryer to be supported from a structure wall. In one embodiment, the male plug can be folded flush with the rear wall of the hand dryer. In another embodiment, the hand dryer also has a laterally extending distal prong which provides additional support for the hand dryer along a structure wall. In yet another embodiment, the hand dryer comprises a spacer on a rear wall of the hand dryer to separate the rear wall from the structure wall.

20 Claims, 4 Drawing Sheets

14
24
46
51
56a
48
50
56b
54
20
10
12
18
60
32
34
40
38
52
36
28
38
38
30
64
62
16
26

14
24
46
10
48
50
20
56a
18
12
60
56b
54
32
34
40
44
42
44
44
44
38
38
36
28
38
30
64
62
26
16

PORTABLE HAND DRYER

BACKGROUND OF THE INVENTION

Hand dryers, wherein the hands of a user are dried by a stream of flowing heated air, are very popular. Hand dryers eliminate the need for towels. Also, eliminating the use of towels minimizes the spread of germs from one user to another, and helps protect the environment by reducing the number of trees having to be sacrificed for paper towels.

Unfortunately, known hand dryers typically are large, bulky machines which are permanently hard wired at a specific location. A truly portable hand dryer has hitherto not been developed.

Accordingly, there is a need for a truly portable hand dryer.

SUMMARY OF THE INVENTION

The invention satisfies this need. In one embodiment, the invention is a hand dryer comprising (a) a housing having an upper end, a lower end, a rear wall, an air inlet opening and a downwardly directed air outlet opening, (b) an electric air blower disposed within the housing, the air blower having an air inlet side and an air discharge side, and (c) air passageways disposed within the housing connecting the air inlet side of the air blower to the air inlet opening of the housing and connecting the air discharge side of the air blower to the air outlet opening of the housing, wherein power for the electric air blower is provided via a male plug having at least two prongs, the male plug being attached to, and projecting outwardly from, the rear wall of the housing, the male plug being sized and dimensioned to plug into a standard household electrical power receptacle, wherein the portable hand dryer weighs less than about 16 ounces, and wherein the housing is adapted to be solely supported from a standard pair of vertically arranged 3-way household electrical outlets, including an upper outlet and a lower outlet, both the upper outlet and the lower outlet comprising a pair of current conducting female connectors and a single female ground connector, the housing being capable of being solely supported from the pair of 3-way outlets by (i) the frictional and mechanical forces existing between the two current conducting female connectors of the upper outlet and the male plug and (ii) the frictional forces between the female ground connector of the lower outlet and a distal prong attached to, and projecting outwardly from, the rearward wall of the housing.

In another embodiment, the invention is a hand dryer comprising (a) a housing having an upper end, a lower end, a rear wall, an air inlet opening disposed in the rear wall and a downwardly directed air outlet opening, (b) an electric air blower disposed within the housing, the air blower having an air inlet side and an air discharge side, and (c) air passageways disposed within the housing connecting the air inlet side of the air blower to the air inlet opening of the housing and connecting the air discharge side of the air blower to the air outlet opening of the housing, wherein power for the electric air blower is provided via a male plug having at least two prongs, the male plug being attached to, and projecting outwardly from, the rear wall of the housing, the male plug being sized and dimensioned to plug into a standard household electrical power receptacle, wherein the portable hand dryer weighs less than about 16 ounces so that the portable hand dryer is capable of being supported on a structure wall solely by frictional and mechanical forces existing between the portable band dryer and one or more standard household electrical receptacles disposed in the structure wall, and wherein a spacer is disposed on the rear wall to separate the rear wall from a structure wall when the portable hand dryer is disposed on the structure wall.

In still another embodiment, the invention is a hand dryer comprising (a) a housing having an upper end, a lower end, a rear wall, an air inlet opening and a downwardly directed air outlet opening, (b) an electric air blower disposed within the housing, the air blower having an air inlet side and an air discharge side, and (c) air passageways disposed within the housing connecting the air inlet side of the air blower to the air inlet opening of the housing and connecting the air discharge side of the air blower to the air outlet opening of the housing, wherein power for the electric air blower is provided via a male plug having at least two prongs, the male plug being attached to, and projecting outwardly from, the rear wall of the housing, the male plug being sized and dimensioned to plug into a standard household electrical power receptacle, wherein the portable hand dryer weighs less than about 16 ounces so that the portable hand dryer is capable of being supported on a structure wall solely by the frictional and mechanical forces existing between the portable hand dryer and one or more standard household electrical power receptacles, and wherein the at least two prongs of the male plug are rotatable between (i) a first plug position wherein the at least two prongs project outwardly from the rear wall of the housing, and (ii) a second plug position wherein the at least two prongs do not project outwardly from the rear wall of the housing.

DESCRIPTION OF THE DRAWINGS

These and other features, aspects and advantages of the present invention will become better understood with reference to the following description, appended claims and accompanying drawings where:

DETAILED DESCRIPTION

Figure 1:
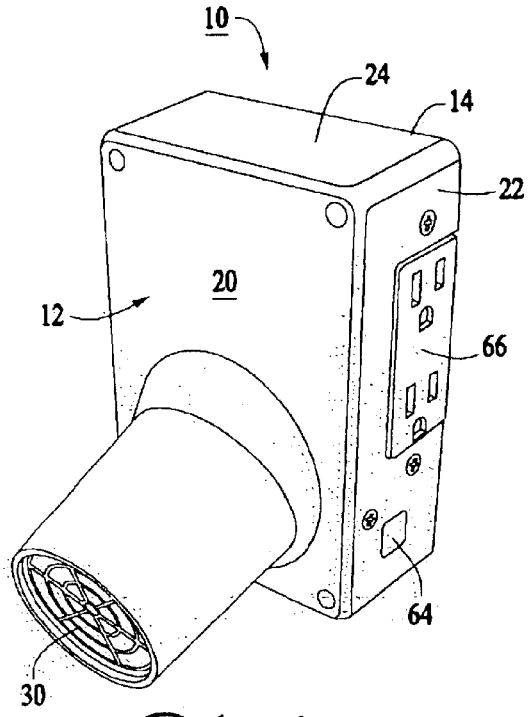
FIG. 1 is a first perspective view of a hand dryer having features of the invention, showing the front side of the hand dryer.
Figure 2:
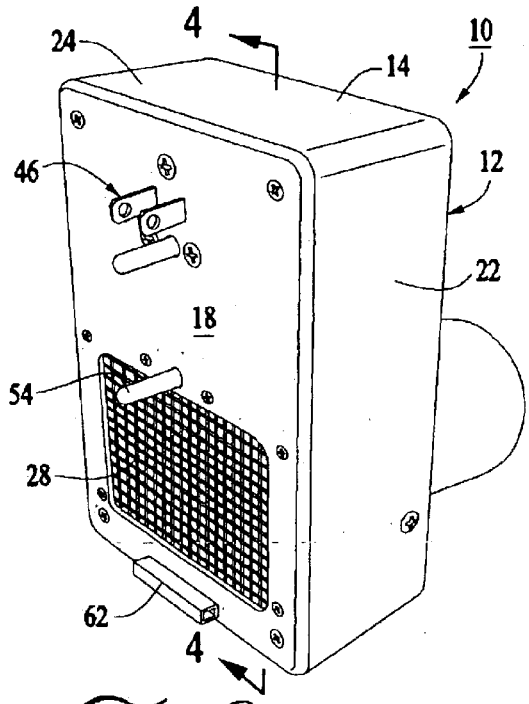
FIG. 2 is a second perspective view of the hand dryer illustrated in FIG. 1, showing the rear side of the hand dryer.

The following discussion describes in detail one embodiment of the invention and several variations of that embodiment. This discussion should not be construed, however, as limiting the invention to those particular embodiments.

Practitioners skilled in the art will recognize numerous other embodiments as well.

The invention is a portable hand dryer. The hand dryer comprises a housing 12 having an upper end 14, a lower end 16 and a rear wall 18. In the embodiment illustrated in the drawings, the housing 12 is a six-sided box further comprising a front wall 20, a pair of opposed side walls 22, a top wall 24 and a bottom wall 26. In one illustrative example of such an embodiment, the front wall 20 and the rear wall 18 are 4"×6", the pair of opposed side walls 22 are 2"×6" and the top wall 24 and bottom walls 26 are 2"×4".

The housing 12 further comprises an air inlet opening 28 and a downwardly directed air outlet opening 30. In the embodiment illustrated in the drawings, the air inlet opening 28 is disposed in the rear wall 18 and the air outlet opening 30 is disposed in the front wall 20.

Figure 3:
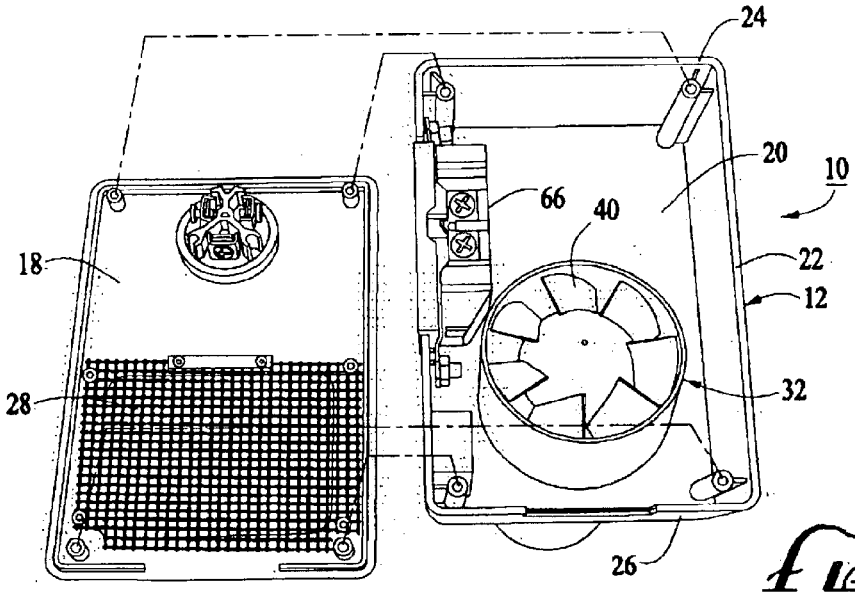
FIG. 3 is an exploded view of the hand dryer illustrated in FIG. 1, showing the interior of the hand dryer.
Figure 4A:
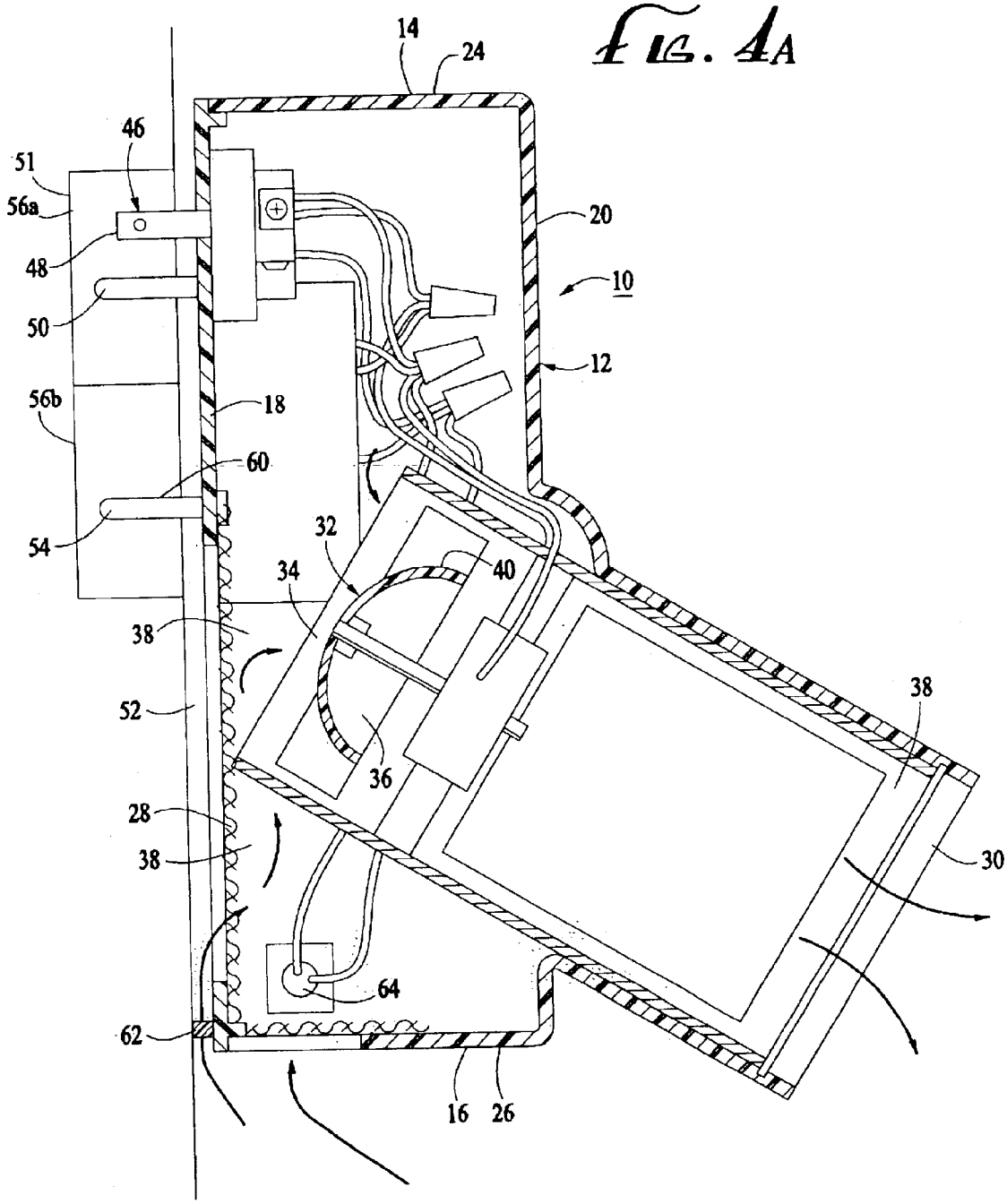
FIG. 4A is a cross-sectional side view of the hand dryer illustrated in FIG. 2, taken along line 4—4.
Figure 4B:
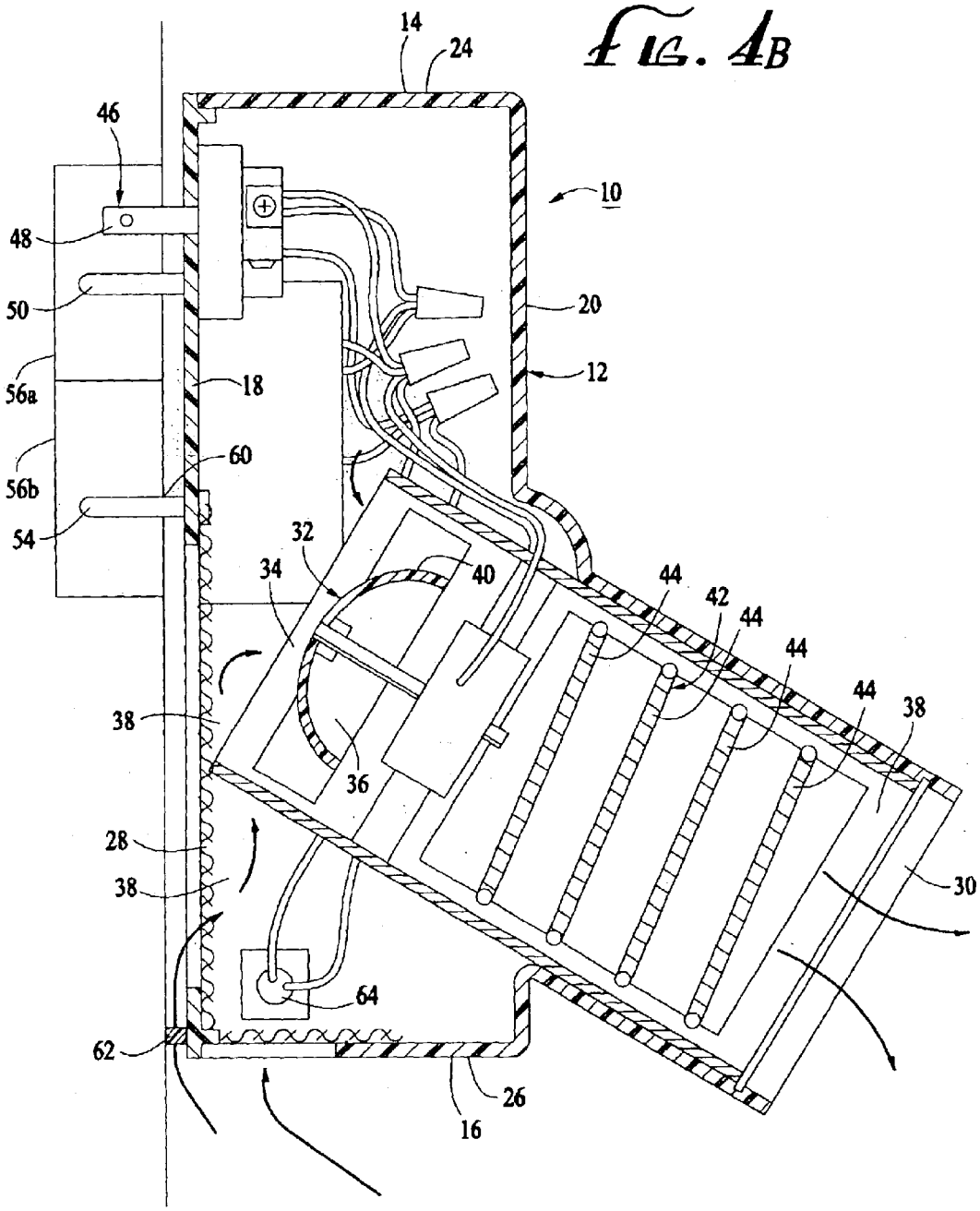
FIG. 4B is a alternative cross-sectional side view of the hand dryer illustrated in FIG. 2, taken along line 4—4.

As illustrated in FIGS. 3, 4A and 4B, the hand dryer 10 further comprises an electric air blower 32 disposed within the housing 12. The air blower 32 has an air inlet side 34 and an air discharge side 36. Air passageways 38 are defined within the housing 12 connecting the air inlet side 34 of the air blower 32 to the air inlet opening 28 of the housing 12 and connecting the air discharge side 36 of the air blower 32 to the air outlet opening 28 of the housing 12. Thus, when the air blower 32 is operating, inlet air is sucked into the air inlet opening 28 in the housing 12 and into the air intake side 34 of the air blower 32. From the air blower 32, air is forced through an air passageway 38 on the discharge side 36 of the air blower 32 to the air outlet opening 30 where it is forced to exit the air outlet opening 30 at high velocity. Air flowing from the air outlet opening 30 can be conveniently used to dry the hands of the user.

In a typical embodiment, the air blower 32 has an impeller fan 40 with a diameter of 2.5".

Optionally, the hand dryer 10 can further comprise an electric heater 42 disposed within the housing 12 for heating air within the air passageways 38. In the embodiment illustrated in FIG. 4B, the electric heater 42 includes heating coils 44 disposed within the downwardly directed air outlet opening 30. In a typical embodiment, the electric heater 42 has a power rating of 1,000–1,875 watts.

Figure 8:
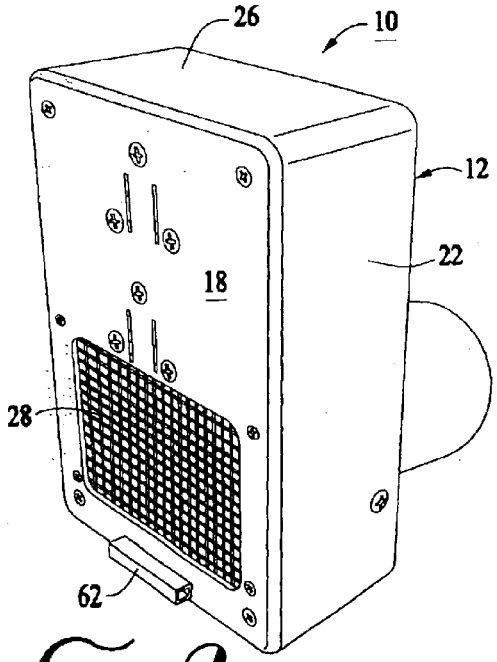
FIG. 8 is a sixth perspective view of the portable hand dryer illustrated in FIG. 1, showing a fourth alternative rear view of the hand dryer.

In one embodiment (illustrated in FIG. 8), the hand dryer 10 comprises no air heater 42. It has been found that the user of the hand dryer 10 is able to dry his or her hand quickly and effectively in a flowing stream of non-heated air. This is surprising since the use of heater air in a hand dryer is generally considered to be necessary.

Figure 5:
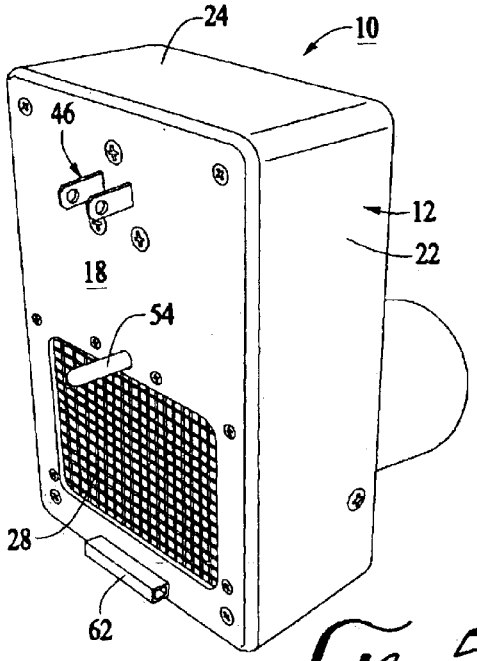
FIG. 5 is a third perspective view of the portable hand dryer illustrated in FIG. 1, showing a first alternative rear view of the hand dryer.
Figure 6:
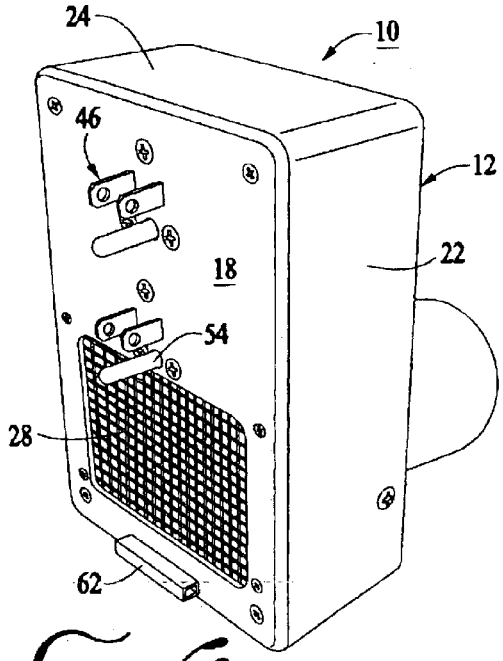
FIG. 6 is a fourth perspective view of the portable hand dryer illustrated in FIG. 1, showing a second alternative rear view of the hand dryer.
Figure 7:
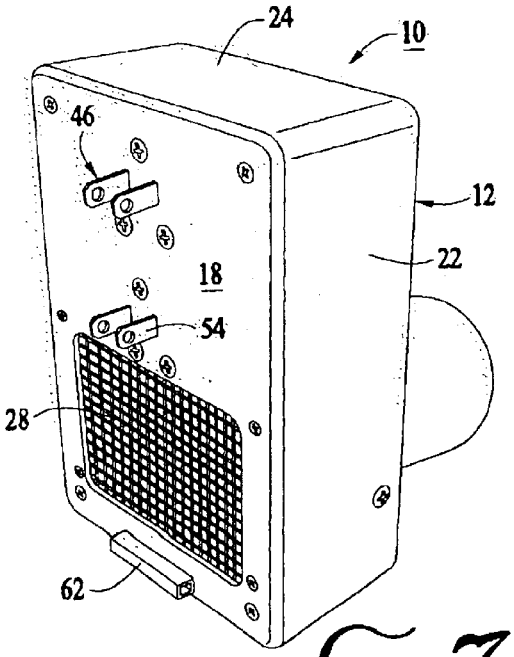
FIG. 7 is a fifth perspective view of the portable hand dryer illustrated in FIG. 1, showing a third alternative rear view of the hand dryer.

Electrical power for the electric air blower 32 and for the optional electric heater 42 is provided in the invention via a male plug 46 projecting outwardly from the rear wall 18 of the housing 12. The male plug 46 has at least two current carrying prongs 48. Typically, the male plug 46 is either a two-prong plug, such as illustrated in FIGS. 5 and 7, having two current carrying prongs 48, or a three-prong plug, such as illustrated in FIGS. 2, 4A, 4B and 6, having two current carrying prongs 48 and one ground connector prong 50. In all cases, the male plug 46 is sized and dimensioned to plug into a standard household female electrical power receptacle 51.

The hand dryer 10 is adapted to be supported on the wall 52 of a structure, in part, by the frictional and mechanical forces existing between the male plug 46 and a standard household electrical power receptacle 56 disposed within the wall 52. In this regard, the portable hand dryer 10 weighs less than about 16 ounces, typically between about 10 ounces and about 16 ounces.

In one embodiment of the invention (illustrated in FIGS. 2, 4A, 4B, 5 and 6), the housing 12 further comprises a distal prong 54 disposed below the male plug 46 on the rear wall 18 of the housing 12. The distal prong 54 and the male plug 46 are vertically aligned such that the housing 12 can be solely supported from a pair of vertically arranged three-way household electrical (female) receptacles 56 having an upper outlet 56*a* and a lower outlet 58*b*. The male plug 46 and the distal prong 54 are vertically disposed such that the male plug 46 can be plugged into the upper outlet of the pair of household electrical receptacles 56*a* and the distal prong 54 can be disposed into the female ground connector 60 of the lower outlet 56*b*. The frictional and mechanical forces existing between the distal prong 54 and the female ground connector 60 of the lower outlet 5*b* provides additional support for the hand dryer 10 on the wall 52 of a structure. In another embodiment (illustrated in FIG. 6), the distal prong 54 is the ground connector of a male plug having three prongs, a pair of current carrying prongs and a ground connector prong. In another embodiment (illustrated in FIG. 7), the distal prong 54 is a pair of male current carrying prongs.

In another optional embodiment, the at least two prongs 48 of the male plug 46 are rotatable between (i) a first plug position wherein the at least two prongs 48 project outwardly from the rear wall 18 of the housing 12, and (ii) a second plug position wherein the at least two prongs 48 do not project outwardly from the rear wall 18 of the housing 12. Where such an embodiment has a distal prong 54, the distal prong 54 is typically also rotatable between (i) a first distal prong 54 position wherein the distal prong projects outwardly from the rear wall 18 of the housing 12, and (ii) a second distal prong position wherein the distal prong 54 does not project outwardly from the rear wall 18 of the housing 12. Such embodiments allow the rearwardly projecting prongs 46 and 54 to be folded into the housing 12 for ease of transport and storage.

As illustrated in the drawings, a preferred embodiment of the invention further comprises the invention further comprises a spacer 62 disposed on the rear wall 18 to separate the rear wall 18 from a structure wall 52 when the portable hand dryer 10 is disposed on the structure wall 52. In such embodiments, the flow of air into the air inlet opening 28 is not impeded by any overly close clearances between the rear wall 18 and the structure wall 52.

The portable hand dryer 10 can also comprise an optional on-off switch 64 so that the hand dryer 10 can be turned off without having to remove the hand dryer 10 from the electrical receptacles in the structure wall 52. The on-off switch 64 can optionally have a one-minute relay (not shown) capable of automatically shutting off the hand dryer 10 after it runs for one minute. Relays allowing different run times are also possible. In another optional embodiment, the on-off switch 64 can include a sensor (not shown) capable of only allowing the operation of the hand dryer 10 when the hands of the user are perceived to be proximate to the air outlet opening 30.

The portable hand dryer 10 can also comprise an optional pair of female electrical receptacles 66 disposed in one of the walls of the housing 12. Such female receptacles 66 provide the user with access to electrical power for other appliances when the hand dryer 10 is covering the electrical power receptacles 56 disposed within the wall 52 of the structure.

The portable band dryer 10 of the invention has been found to provide an effective, yet lightweight and inexpensive device for drying one's hands. Unlike other hand dryers, the hand dryer of the invention 10 is truly portable and is extremely convenient to pack, carry and use away from home.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A portable hand dryer comprising:

(a) a housing having an upper end, a lower end, a rear wall, an air inlet opening and a downwardly directed air outlet opening;

(b) an electric air blower disposed within the housing, the air blower having an air inlet side and an air discharge side; and (c) air passageways disposed within the housing connecting the air inlet side of the air blower to the air inlet opening of the housing and connecting the air discharge side of the air blower to the air outlet opening of the housing;

wherein power for the electric air blower is provided via a male plug having at least two prongs, the male plug being attached to, and projecting outwardly from, the rear wall of the housing, the male plug being sized and dimensioned to plug into a standard household electrical power receptacle;

wherein the portable hand dryer weighs less than about 16 ounces; and wherein the housing is adapted to be solely supported from a standard pair of vertically arranged 3-way household electrical outlets, including an upper outlet and a lower outlet, both the upper outlet and the lower outlet comprising a pair of current conducting female connectors and a single female ground connector, the housing being capable of being solely supported from the pair of 3-way outlets by (i) the frictional and mechanical forces existing between the two current conducting female connectors of the upper outlet and the male plug and (ii) the frictional forces between the female ground connector of the lower outlet and a distal prong attached to, and projecting outwardly from, the rearward wall of the housing.

2. The portable hand dryer of claim 1 further comprising an electric heater disposed within the housing for heating air within the air passageways.

3. The portable hand dryer of claim 1 wherein the portable hand dryer comprises no air heater.

4. The portable hand dryer of claim 1 wherein the male plug has three prongs, a pair of current carrying prongs and a ground connector prong.

5. The portable hand dryer of claim 1 wherein the distal prong is the ground connector prong of a male plug having three prongs, a pair of current carrying prongs and a ground connector prong.

6. The portable hand dryer of claim 1 wherein the at least two prongs of the male plug are rotatable between (i) a first plug position wherein the at least two prongs project outwardly from the rear wall of the housing, and (ii) a second plug position wherein the at least two prongs do not project outwardly from the rear wall of the housing, and wherein the distal prong is rotatable between (i) a first distal prong position wherein the distal prong projects outwardly from the rear wall of the housing, and (ii) a second distal prong position wherein the distal prong does not project outwardly from the rear wall of the housing.

7. The portable hand dryer of claim 1 further comprising a spacer disposed on the rear wall to separate the rear wall from a structure wall when the portable hand dryer is disposed on the structure wall.

8. The portable hand dryer of claim 1 further comprising an on/off switch.

9. The portable hand dryer of claim 1 wherein the housing further comprises at least one standard female electrical power receptacle electrically connected to the male plug.

10. A portable hand dryer comprising:

(a) a housing having an upper end, a lower end, a rear wall, an air inlet opening disposed in the rear wall and a downwardly directed air outlet opening;

(b) an electric air blower disposed within the housing, the air blower having an air inlet side and an air discharge side; and (c) air passageways disposed within the housing connecting the air inlet side of the air blower to the air inlet opening of the housing and connecting the air discharge side of the air blower to the air outlet opening of the housing;

wherein power for the electric air blower is provided via a male plug having at least two prongs, the male plug being attached to, and projecting outwardly from, the rear wall of the housing, the male plug being sized and dimensioned to plug into a standard household electrical power receptacle;

wherein the portable hand dryer weighs less than about 16 ounces so that the portable hand dryer is capable of being supported on a structure wall solely by frictional and mechanical forces existing between the portable hand dryer and one or more standard household electrical receptacles disposed in the structure wall; and wherein a spacer is disposed on the rear wall to separate the rear wall from a structure wall when the portable hand dryer is disposed on the structure wall.

11. The portable hand dryer of claim 10 further comprising an electric heater disposed within the housing for heating air within the air passageways.

12. The portable hand dryer of claim 10 wherein the portable hand dryer comprises no air heater.

13. The portable hand dryer of claim 10 wherein the male plug has three prongs, a pair of current carrying prongs and a ground connector prong.

14. The portable hand dryer of claim 10 wherein the at least two prongs of the male plug are rotatable between (i) a first plug position wherein the at least two prongs project outwardly from the rear wall of the housing and (ii) a second plug position wherein the at least two prongs do not project outwardly from the rear wall of the housing.

15. The portable hand dryer of claim 10 further comprising an on/off switch.

16. A portable hand dryer comprising:

(a) a housing having an upper end, a lower end, a rear wall, an air inlet opening and a downwardly directed air outlet opening;

(b) an electric air blower disposed within the housing, the air blower having an air inlet side and an air discharge side; and (c) air passageways disposed within the housing connecting the air inlet side of the air blower to the air inlet opening of the housing and connecting the air discharge side of the air blower to the air outlet opening of the housing;

wherein power for the electric air blower is provided via a male plug having at least two prongs, the male plug being attached to, and projecting outwardly from, the rear wall of the housing, the male plug being sized and dimensioned to plug into a standard household electrical power receptacle;

wherein the portable hand dryer weighs less than about 16 ounces so that the portable hand dryer is capable of being supported on a structure wall solely by the frictional and mechanical forces existing between the portable hand dryer and one or more standard household electrical power receptacles; and wherein the at least two prongs of the male plug are rotatable between (i) a first plug position wherein the at least two prongs project outwardly from the rear wall of the housing, and (ii) a second plug position wherein the at least two prongs do not project outwardly from the rear wall of the housing.

17. The portable hand dryer of claim 16 further comprising an electric heater disposed within the housing for heating air within the air passageways.

18. The portable hand dryer of claim 16 wherein the portable hand dryer comprises no air heater.

19. The portable hand dryer of claim 16 wherein the male plug has three prongs, a pair of current carrying prongs and a ground connector prong.

20. The portable hand dryer of claim 16 further comprising air on/off switch.

* * * * *